US005397268A

United States Patent [19]

Chang et al.

[11] Patent Number: 5,397,268

[45] Date of Patent: Mar. 14, 1995

[54] INTEGRATED SUNSHADE AND FAN APPARATUS

[76] Inventors: Kil J. Chang, 321-40 Soksu 2 Dong, Anyang City, Kyunggido; Se I. Kim, 1215-103 Mokdong Apt. Sinjung Dong Yangchungu, Seoul, both of Rep. of Korea; Yanon Volcani, 305 Birdrock Ave., La Jolla, Calif. 92037

[21] Appl. No.: 72,461

[22] Filed: Jun. 4, 1993

[51] Int. Cl.[6] ..... F24F 7/007

[52] U.S. Cl. ..... 454/338; 297/184.1; 454/370

[58] Field of Search ..... 297/180.13, 180.14, 297/184.1; 454/338, 370

[56] References Cited

U.S. PATENT DOCUMENTS

| | | | |
|---|---|---|---|
| D. 323,582 | 2/1992 | Volcani | D3/5 |
| 3,228,317 | 1/1966 | Westman | 454/370 X |
| 4,687,414 | 8/1987 | Wardy | 454/370 X |
| 5,033,528 | 7/1991 | Volcani | 160/351 |

FOREIGN PATENT DOCUMENTS

| | | | |
|---|---|---|---|
| 65897 | 4/1982 | Japan | 454/338 |
| 476724 | 12/1937 | United Kingdom | 454/338 |
| 584657 | 1/1947 | United Kingdom | 454/338 |

*Primary Examiner*—Harold Joyce
*Attorney, Agent, or Firm*—John R. Flanagan

[57] ABSTRACT

An integrated sunshade and fan apparatus includes a personal portable sunshade device and a fan assembly integrated thereon which together respectively shade a selected portion of a user's body and generate a cooling airflow over a substantial portion of the user's body. The sunshade device includes a shading disc having a surface area sized for shading a portion of the user's body and a mounting assembly attached to the shading disc for mounting the device to a support structure, such as a chair side. The shading disc has an opening formed therethrough within the peripheral edge of the disc. The fan assembly includes a holding structure attached on the shading disc about the opening therethrough and a fan unit supported by the holding structure in alignment with the opening. The fan unit is operable for generating and directing an airflow through the opening in the shading disc.

19 Claims, 1 Drawing Sheet

INTEGRATED SUNSHADE AND FAN APPARATUS

BACKGROUND OF THE INVENTION

1. Field of the Invention

The present invention generally relates to devices for increasing personal comfort and, more particularly, is concerned with an integrated sunshade and fan apparatus.

2. Description of the Prior Art

It is common practice for persons to relax in the sun by sunbathing at a beach or near a pool or by even sitting in one's automobile. Yet it is not always desirable to have the sun's rays impinge directly on the body's sensitive facial areas. It is widely recognized that the sun has harmful rays that can damage one's skin or irritate one's eyes.

A personal portable sunshade device devised heretofore to address the aforementioned problem is disclosed in U.S. Pat. No. 5,033,528 to Yanon Volcani, one of the co-inventors of the subject invention herein. The Volcani sunshade device employs a large disc of opaque material having a surface area sufficient for providing shading of a particular portion of a user's body, such as facial areas, from the sun's rays. The disc is supported at its edge by a flexible extension that is connected to a rigid extension which, in turn, is connected to a free-standing base or to a clamp which can be temporarily attached to a lounge chair, car seat, or the like.

The Volcani sunshade device provides a solution which adequately addresses the problem of how to effectively block the direct impingement of the sun's rays on the selected sensitive areas of one's body. However, the amount of time a person is able to relax in the sun can still be shortened due to general personal discomfort arising from overheating of the unshaded areas of one's body by the sun's rays which is a problem not addressed by the Volcani sunshade device.

Thus, notwithstanding the satisfactory performance of the patented Volcani sunshade device, a need still exists for some additional step to be taken to increase one's personal comfort while relaxing in the sun.

SUMMARY OF THE INVENTION

The present invention provides an integrated sunshade and fan apparatus designed to satisfy the aforementioned needs by supplementing the benefits fostered by the patented Volcani sunshade device. The integrated sunshade and fan apparatus of the present invention increases personal comfort, over that attained heretofore, by shielding a selected region of user's body from the harmful effects of the sun's rays and, at the same time, generating a general cooling airflow over most of the user's body.

Accordingly, the present invention is directed to an integrated sunshade and fan apparatus which comprises a personal portable sunshade and a fan assembly being integrated thereon. The integrated sunshade and fan apparatus respectively shades a selected portion of a user's body and generates a cooling airflow over a substantial portion of the user's body.

More particularly, the sunshade device includes a shading disc having a surface area sized for shading a portion of the user's body and means attached to the shading disc for mounting the device to a support structure. The shading disc has an opening formed therethrough. The fan assembly includes a holding structure attached on the shading disc about the opening therethrough and a fan unit supported by the holding structure in general alignment with the opening through the shading disc, the fan unit being operable for generating an airflow through the opening in the shading disc.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
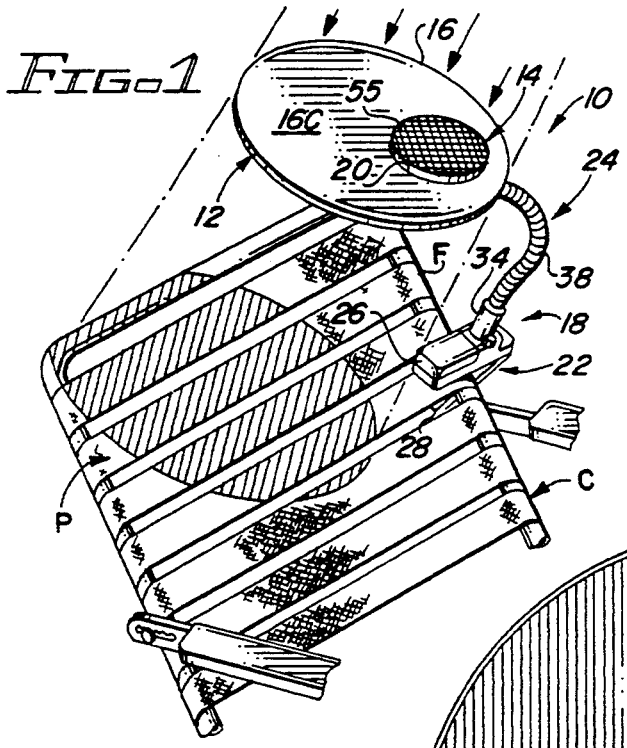
FIG. 1 is a perspective view of an integrated sunshade and fan apparatus of the present invention mounted to an upper side frame of a lawn or beach foldable chair.
Figure 5:
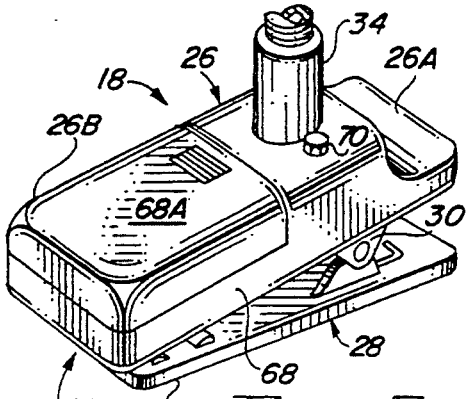
FIG. 5 is an enlarged perspective view of a support clamp of the mounting assembly of the integrated apparatus.

Referring to the drawings and particularly to FIG. 1, there is illustrated an integrated sunshade and fan apparatus of the present invention, being generally designated 10. As an example, the integrated apparatus 10 is shown mounted to an upper side frame F of a lawn or beach foldable chair C. The integrated apparatus 10, of course, may be mounted on other kinds of support structures. Basically, the integrated apparatus 10 includes a personal portable sunshade device 12 and a fan assembly 14 integrated thereon. Except for certain important differences pointed out hereinafter, the construction of the sunshade device 12 is substantially similar to that illustrated and described in above-cited U.S. Pat. No. 5,033,528, the disclosure of which is hereby incorporated herein by reference thereto.

Referring to FIGS. 1–4, the sunshade device 12 of the integrated apparatus 10 basically includes a shading disc 16 and a mounting assembly 18. The shading disc 16 of the sunshade device 12 is constructed of any suitable relatively stiff and substantially opaque material, such as a paperboard or plastic material, and preferably has a circular shape, although other configurations are possible. As seen in FIG. 1, the shading disc 16 has a surface area sized for shading a portion P of the chair C from direct contact by the sun's rays (as represented by arrows in FIG. 1) and thereby similarly shading a portion of the body, such as the face, of a user while reclining on the chair C. However, unlike the shading disc disclosed in the above-cited patent, the shading disc 16 herein has an opening 20 formed therethrough preferably circular in configuration and defined within a lower semi-circular portion of the disc 16 and also within the peripheral edge 16A thereof.

The mounting assembly 18 of the sunshade device 12 is adapted for mounting the shading disc 16 in a desired selected position above the chair C. Basically, the mounting assembly 18 includes a support clamp 22 and an elongated connecting member 24. The support clamp 22 of the mounting assembly 18 has upper and lower jaw members 26, 28, each having respective opposite finger gripping ends 26A, 28A and support structure clamping ends 26B, 28B. The upper and lower jaw members 26, 28 are hingedly connected together by a pin 30 and have a biasing means in the form of a coil spring 32 mounted about the pin 30 and between the jaw members 26, 28 so as to bias the upper and lower jaw members 26, 28 for pivotal movement in a first direction relative to one another toward a closed position in which their respective clamping ends 26B, 28B are substantially engaged with one another. When a user applies pressure on the gripping ends 26A, 28A of the jaw members 26, 28 to cause them to move toward one another, the coil spring 32 is adapted to yield and permit the jaw members 26, 28 to pivotally move in a second opposite direction relative to one another about the hinge pin 30 toward an opened position in which their respective clamping ends 26B, 28B are spaced from one another.

The elongated connecting member 24 of the mounting assembly 18 includes a pair of first and second short rigid hollow tubular sections 34, 36 at its opposite ends and a long flexible tubular section 38 extending between and connected with the first and second short rigid hollow tubular sections 34, 36. The first short rigid hollow tubular section 34 is rigidly attached upright on one end portion of the upper jaw member 26 of the support clamp 22. The long flexible tubular section 38 preferably is in the form of a conventional hollow flexible gooseneck-type cable 38 which permits the shading disc 16 to be moved universally relative to the support clamp 22. As will be described below, the second short rigid hollow tubular section 36 of the elongated connecting member 24 of the mounting assembly 18 is attached to the shading disc 16 in a different arrangement from that disclosed in the above-cited patent.

Figure 2:
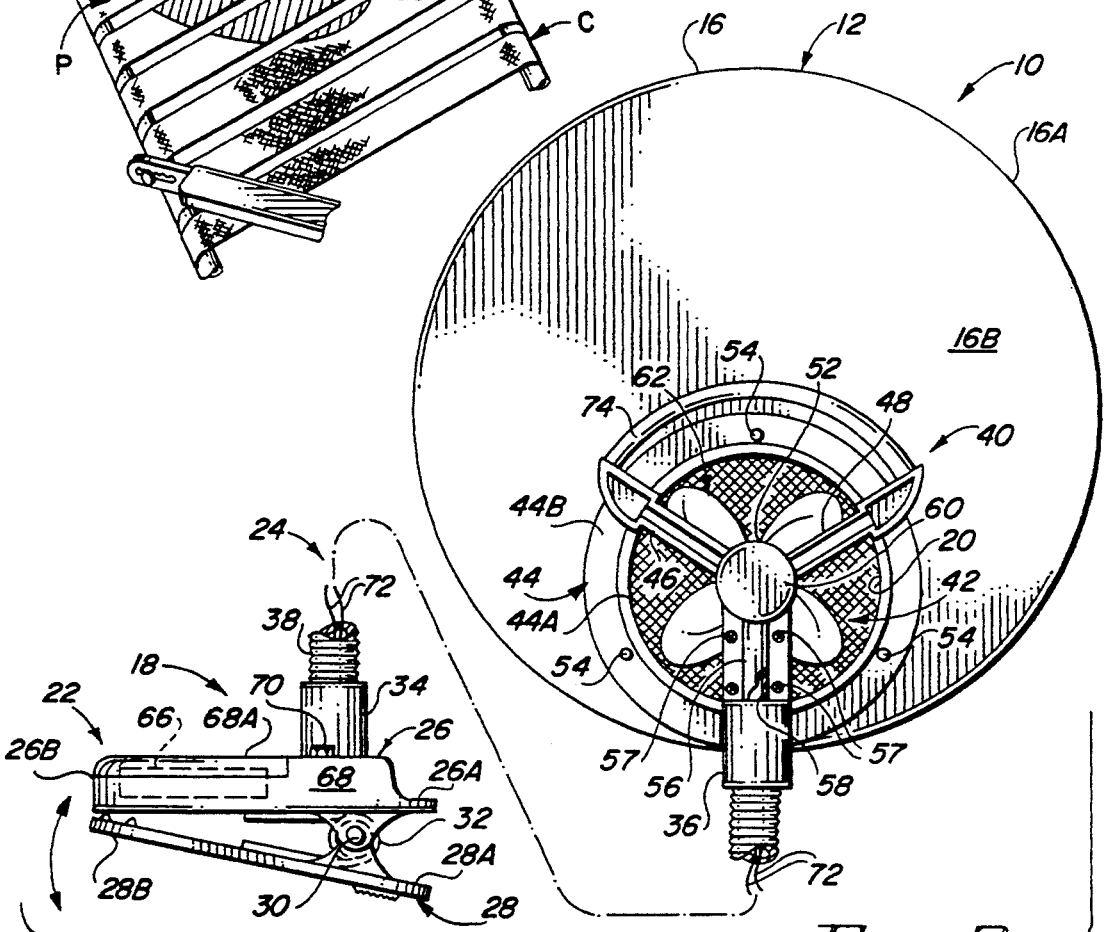
FIG. 2 is an enlarged fragmentary side elevational view of a shading disc, mounting assembly and fan assembly of the integrated apparatus.
Figure 3:
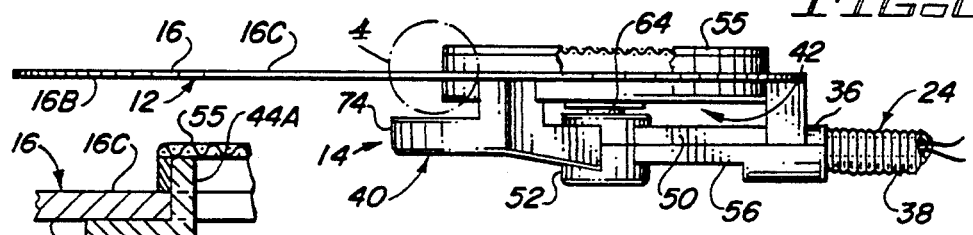
FIG. 3 is a edge elevational view of the shading disc and fan assembly of the integrated apparatus.

Referring to FIGS. 1–3, the fan assembly 14 of the integrated device 10 basically includes a holding structure 40 attached on the shading disc 16 about the opening 20 therethrough and an electrically-motorized fan unit 42 supported by the holding structure 40 generally across the opening 20 of the shading disc 16. The fan unit 42 is operable for generating an airflow through the opening 20 in the shading disc 16 and generally perpendicular to the plane of the disc 16.

Figure 4:
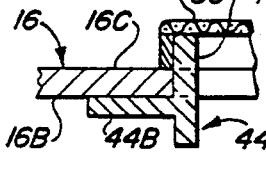
FIG. 4 is an enlarged detailed sectional view of the portion of the integrated apparatus contained in circle 4 of FIG. 3.

More particularly, as seen in FIGS. 2–4, the holding structure 40 includes annular rim 44, a plurality of radial arms 46, 48 and 50, and a central hub 52. The annular rim 44 has an inner annular portion 44A and an outer annular portion 44B rigidly attached to and extending about the exterior of the inner annular portion 44A. The inner annular portion 44A is in the shape of a cylindrical ring and has an outside diameter slightly smaller than the opening 20 in the shading disc 16 and an axially extending width substantially greater than the thickness of the disc 16 such that the inner annular portion 44A seats through the opening 20 so as to project in opposite directions from opposite front and rear surfaces 16B, 16C of the disc 16. The outer annular portion 44B lies in a plane and is spaced from the opposite axial spaced ends of the inner annular portion 44A. With the inner annular portion 44A extending through the opening 20 in the disc 16, the outer annular portion 44B seats against the front surface 16B of the disc 16 and is attached thereto by any suitable fastening means, such as screws 54 or, alternatively, a suitable adhesive can be used. A circular screen 55 is removably fitted over the inner annular portion 44A of the annular rim 44 adjacent to the front surface 16B of the shading disc 16.

The radial arms 46, 48 and 50 of the holding structure 40 are rigidly attached at their outer ends to the inner and outer annular portions 44A, 44B of the annular rim 44 and are circumferentially displaced from one another by approximately 120°. At their inner ends, the radial arms 46, 48, 50 are rigidly attached to the exterior of the central hub 52 so as to position the hub 52 is a spaced relation from the rear side of the opening 20 through the shading disc 16 and in axial alignment with the central axis of the opening 20. The one radial arm 50 is rigidly attached to the second rigid hollow tubular section 36 of the elongated connecting member 24 and also has a channel piece 56 attached thereon by screws 57 which piece 56 defines a passageway 58 leading from the interior of the second tubular section 36 to the interior of the central hub 52.

The fan unit 42 includes an electric motor 60 securely mounted within the central hub 52 and a multiple blade structure 62 secured on an outer end of a drive shaft 64 of the motor 60. The multiple blade structure 62 is preferably constructed of a flexible soft fabric material so as to avoid the possibility of injury to the user's fingers should inadvertent contact be made by the fingers with the rotating blade structure 62. The multiple blade structure 62 is positioned generally within a cylindrical envelope defined by the inner annular portion 44A of the annular rim 44.

The fan assembly 14 also includes a source of electrical power for operating the electric motor 60 of the fan unit 42 being provided by batteries 66, such as two 1.5 volt d.c. batteries, contained in a battery box 68 defined on the upper jaw member 26 of the support clamp 22. The battery box 68 includes a removable cover 68A for gaining access to the batteries 66. Also, the fan assembly 14 includes an on/off switch 70 mounted on the upper jaw member 26 and electrical conductors 72 extending through the hollow interiors of the hollow tubular sections 34, 36, 38 and the upper jaw member 26 and channel piece 56 and electrically connecting the electric motor 60, batteries 66 and on/off switch 70 in series.

Finally, for carrying or moving the sunshade device 12, the support clamp 22 of the mounting assembly 18 and an arcuate shaped handle 74 provided between and rigidly connected to the outer ends of the two radial arms 46, 48 can be grasped by the same hand or both hands of the user. The provision of the handle 74 discourages handling of the sunshade device 12 by grasping an edge portion of the shading disc 16 which due to the added weight of the fan assembly 14 might tend to cause the disc 16 to bend and become damaged. It should be noted that sufficient space is available on both surfaces 16B, 16C of the shading disc 16 on which to imprint logos and advertising matter.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. An integrated sunshade and fan apparatus for respectively shading a selected portion of a user's body and providing a cooling airflow over a substantial portion of the user's body, said apparatus comprising:

(a) a sunshade device including a shading disc having a surface area sized for shading a portion of the user's body and means attached to said shading disc for mounting said device to a support structure, said shading disc having an opening formed therethrough; and (b) a fan assembly including a holding structure attached on said shading disc about said opening therethrough and a fan unit supported by said holding structure in general alignment with said opening through said shading disc, said fan unit being operable for generating an airflow through said opening in said disc;

(c) said shading disc mounting means including a support clamp having hinged jaw members and an elongated connecting member attached to and extending between said support clamp and said holding structure of said fan assembly.

2. The apparatus of claim 1 wherein said holding structure includes an annular rim seated about said opening in said shading disc and being attached to said disc.

3. The apparatus of claim 2 wherein said annular rim includes:

an inner annular portion in the shape of a cylindrical ring seated through said opening so as to project in opposite directions from opposite front and rear surfaces of said disc; and an outer annular portion rigidly attached to and extending about an exterior of said inner annular portion, said outer annular portion seated against one of said opposite surfaces of said disc and attached thereto.

4. The apparatus of claim 3 wherein said fan assembly includes a circular screen fitted over said inner annular portion of said annular rim adjacent to one of said opposite surfaces of said disc.

5. The apparatus of claim 2 wherein said holding structure also includes a plurality of radial arms being attached at outer ends to said annular rim at locations being circumferentially displaced from one another.

6. The apparatus of claim 5 wherein said holding structure further includes a central hub, said radial arms at inner ends being attached to said central hub so as to position said hub in alignment with said opening through said shading disc.

7. The apparatus of claim 6 wherein said fan unit includes:

an electric motor mounted within said central hub and having an output drive shaft; and a multiple blade structure secured on an outer end of said output drive shaft of said motor.

8. The apparatus of claim 7 wherein said multiple blade structure is constructed of a flexible soft fabric material.

9. The apparatus of claim 7 wherein said fan assembly also includes a source of electrical power for operating said electric motor of said fan unit being mounted on said shading disc mounting means.

10. The apparatus of claim 2 wherein said holding structure also includes a handle mounted to said annular rim.

11. An integrated sunshade and fan apparatus for respectively shading a selected portion of a user's body and providing a cooling airflow over a substantial portion of the user's body, said apparatus comprising:

(a) a sunshade device including a shading disc having a surface area sized for shading a portion of the user's body and means attached to said shading disc for mounting said device to a support structure, said shading disc having an opening formed therethrough, said shading disc mounting means including a support clamp having hinged jaw members and an elongated connecting member attached to and extending between said support clamp and said shading disc; and (b) a fan assembly including a holding structure attached on said shading disc about said opening therethrough and a fan unit supported by said holding structure in general alignment with said opening through said shading disc, said fan unit being operable for generating an airflow through said opening in said disc.

12. The apparatus of claim 10 wherein said holding structure includes an annular rim seated about said opening in said shading disc and being attached to said disc, said annular rim including an inner annular portion and an outer annular portion, said inner annular portion being in the shape of a cylindrical ring seated through said opening so as to project in opposite directions from opposite front and rear surfaces of said disc, said outer annular portion being rigidly attached to and extending about an exterior of said inner annular portion, said outer annular portion seated against one of said opposite surfaces of said disc and attached thereto.

13. The apparatus of claim 12 wherein said holding structure also includes a plurality of radial arms being attached at outer ends to said annular rim at locations being circumferentially displaced from one another.

14. The apparatus of claim 13 wherein said holding structure also includes a handle mounted to and extending between outer ends of a pair of said radial arms.

15. The apparatus of claim 13 wherein said holding structure further includes a central hub, said radial arms at inner ends being attached to said central hub so as to position said hub in alignment with said opening through said shading disc.

16. The apparatus of claim 15 wherein said fan unit includes:

an electric motor mounted within said central hub and having an output drive shaft; and a multiple blade structure secured on an outer end of said output drive shaft of said motor.

17. The apparatus of claim 16 wherein said multiple blade structure is constructed of a flexible soft fabric material.

18. The apparatus of claim 16 wherein said fan assembly also includes a source of electrical power for operating said electric motor of said fan unit being mounted on said support clamp.

19. The apparatus of claim 11 wherein said holding structure also includes a handle.

* * * * *